US011834303B2

(12) United States Patent
Franke

(10) Patent No.: US 11,834,303 B2
(45) Date of Patent: Dec. 5, 2023

(54) CARRYING MEANS

(71) Applicant: SPANSET AXZION GMBH, Langenfeld (DE)

(72) Inventor: Soeren Franke, Haan (DE)

(73) Assignee: SPANSET AXZION GMBH, Langenfeld (DE)

( * ) Notice: Subject to any disclaimer, the term of this patent is extended or adjusted under 35 U.S.C. 154(b) by 128 days.

(21) Appl. No.: 17/442,633

(22) PCT Filed: Mar. 17, 2020

(86) PCT No.: PCT/EP2020/000070
§ 371 (c)(1),
(2) Date: Sep. 24, 2021

(87) PCT Pub. No.: WO2020/192960
PCT Pub. Date: Oct. 1, 2020

(65) Prior Publication Data
US 2022/0185633 A1 Jun. 16, 2022

(30) Foreign Application Priority Data
Mar. 25, 2019 (EP) ..... 19000149

(51) Int. Cl.
*B66C 1/34* (2006.01)
*B66C 1/62* (2006.01)

(52) U.S. Cl.
CPC . *B66C 1/34* (2013.01); *B66C 1/62* (2013.01)

(58) Field of Classification Search
CPC .... B66C 1/26; B66C 1/34; B66C 1/48; B66C 1/62; B66C 1/108
USPC ..... 294/82.12, 82.31, 67.21, 67.5
See application file for complete search history.

(56) References Cited

U.S. PATENT DOCUMENTS 3,606,441 A * 9/1971 Ridgely ..... B66C 1/14 414/626
4,221,419 A * 9/1980 Riley ..... F16B 2/10 294/85
2018/0029844 A1* 2/2018 Franke ..... B66C 1/34

FOREIGN PATENT DOCUMENTS

DE 102011118498 A1 6/2016
DE 102016009269 A1 2/2018
EP 1953111 A2 8/2008
JP 2010269917 A 12/2010

OTHER PUBLICATIONS

International Search Report dated Jun. 17, 2020, in International Application No. PCT/EP2020/000070.
International Preliminary Report on Patentability dated Sep. 28, 2021, in International Application No. PCT/EP2020/000070.

* cited by examiner

*Primary Examiner* — Dean J Kramer
(74) *Attorney, Agent, or Firm* — Wood, Phillips, Katz, Clark & Mortimer

(57) ABSTRACT

A carrier (1) for transporting objects, having a carrying limb (2) and a load handling limb (3), wherein at least one rotatably mounted load support is arranged in the region of a free end (7) of the load handling limb (3), wherein the load support includes a pivotably mounted segment (4) which lies on the free end (7) of the load handling limb (3) and, together therewith, forms a load-carrying bearing and at least one inner surface of the load handling limb (3) forms a bearing shell (5) on the free end (7) and supports the pivotably mounted segment (4).

4 Claims, 2 Drawing Sheets

CARRYING MEANS

Figure 1:
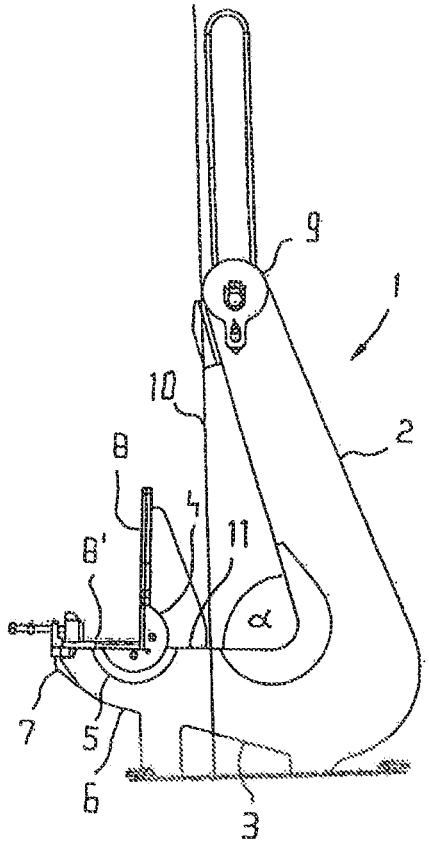

The invention relates to a carrying means for transporting objects, having a carrying limb and a load handling limb.

Various carrying means, primarily load hooks for transporting objects, which have a load support that can be modified are known. Said load support can either be displaced as in DE 10 2005 924 671 A1 Alternatively, the carrying means itself can be rotatably mounted as, for instance, in EP 195 31 11 A2.

In the case of known devices, it has been demonstrated in the past that in the case of components having a defined geometry, for example in the case of elongated tubular objects having a large or oversized flange or having a protruding flange, the self-alignment of a radial segment which handles a load cannot be effected properly in accordance with the action of force during transport. By way of example, this results in tilting of the object to be transported on the hook, and a self-alignment is therefore not guaranteed.

In addition, aforementioned configurations of the carrying means, thus as coil hooks and as hooks having a radial segment which can be rotated on both sides, stand side by side as separate solutions which have not been combined with one another to date. A new carrying means has constantly had to be used for different purposes.

A multifunctional use has not been possible. Thus, it has not been possible, by way of example, to transport, in particular to lift, loads, initially with substantially planar load handling which reaches approximately up to a hook tip, which loads demanded planar load handling designed in such a manner, and to thereafter execute, with the same carrying means, a transport operation, in particular a lifting operation, in which the same or a further load handled by the carrying means aligns itself by means of a radial segment in accordance with the action of force of the load, wherein the force absorption of the load on the carrying means is constantly effected, as in the case of a hook, with a radial segment alone.

The invention has set itself the task of optimizing the disadvantages of the prior art and providing a carrying means which affords a greater range of use and as it were, if necessary, a self-alignment.

This object is achieved according to the invention by a carrying means for transporting objects having the features of claim 1, wherein the subclaims include further configuration variants according to the invention.

Accordingly, the carrying means for transporting objects has a carrying limb and a load, handling limb, wherein at least one rotatably mounted load support is arranged in the region of a free end of the load handling limb, wherein the load support is a radial segment which lies on the free end of the load handling limb and, together therewith, forms a load-carrying bearing and at least one inner surface of the load handling limb forms a bearing shell on the free end, has said bearing shell and corresponds to the radial segment. If merely the segment is referred to below, the radial segment is meant within the meaning of the invention.

Therefore, no shaft is used as a separate component with its disadvantages as a load-carrying bearing. When a shaft or similar constructive designs is/are used, only lower forces can of course be absorbed because the entire load support and alignment in the direction of the action of force of the object to be handled act on the relatively weak shaft. In addition, the shaft is an additional component which causes additional costs.

Furthermore, the load handling limb has a planar inner surface.

Thanks to the embodiment according to the invention, when the radial segment is positioned or aligned accordingly, an enlarged surface can be afforded as a load support from the radial segment up to the apex of the load handling limb and of the carrying limb.

The carrying limb and the load handling limb form, in an embodiment, an acute angle (a). In addition, the carrying limb can also have a planar inner surface, but this is not necessary.

A fastening means can, in turn, be arranged on a further free end of the carrying limb such as, by way of example, a hook cable of a crane or another device for functionally arresting the carrying means.

In a further configuration, the load support limb extends via an imaginary vertical, starting from the further free end of the carrying limb and thus forms an extension region, wherein the load support as the radial segment, the load-carrying beating formed from the load support and the load handling limb, is arranged on the extension region and, consequently, when the segment is positioned or aligned accordingly, the enlarged surface can be afforded in a particular way as a load support from the segment up to the apex of the aforementioned limbs. Thus, depending on the load to be handled, said surface can also be configured in a planar manner. The configuration of the carrying means with the extension region additionally affords an advantageous handling of the carrying means. If the load handling limb is, so to speak, further favored by this arrangement, this affords more space when arranging the load. Furthermore, it can be provided that the load support can be pivoted on multiple sides as a radial segment, starting from a horizontal position of at least one load support face of the segment.

In order to afford a rotational movement of the radial segment, the bearing shell of the load handling limb and the radial segment have the same or virtually the same radius so that the one or the multiple inner surfaces of the load handling limb on the free end and at least one outer surface of the radial segment form surfaces sliding onto one another, which are adapted to one another. Thus, the radial segment is rotatably mounted on the free end of the load handling limb.

In an advantageous configuration, the load support as a segment has at least one load support surface for handling loads. In a further configuration, the segment has two load support surfaces arranged at a right angle to one another. The segment can be pivoted at least from a horizontal position of the one load support surface towards a horizontal position of the further load support surface and in the reverse direction. The load support surfaces are configured depending on the requirements of a load to be transported. They can be configured in a planar manner or substantially in a planar manner or even comprise further devices for arresting a load or parts of a load such as, by way of example, at least one clamping device.

Thanks to its design, the aim is to be able to substantially afford an enlarged surface as a load support from the segment up to the apex of the carrying limb and of the load handling limb. The load support can additionally be embodied so that it can be replaced as a segment and, by way of example, the carrying means serves to transport a tubular object having an oversized flange, thus for transporting components of a wind power plant or pipeline segments. The solution according to the invention affords an optimized self-alignment of the segment under stress in the direction of the action of force of an object to be transported. The invention affords as it were, depending on the alignment of the segment, a surface as a load support from the segment up to the hook mouth so that an enlarged range of use of the carrying means is made possible. Thus, it is now possible to transport, in particular to lift, loads with a load support which is extended or can be extended in a position of the radial segment, which load support can reach approximately up to a hook tip, which loads demand load handling designed in such a way, and thereafter, with the same carrying means, for example also with respect to a further load, to execute a transport operation, in which the load aligns itself by means of the radial segment in accordance with the action of force of the object to be transported, that is to say of the load, and does so, affording an optimized handling and diversion of forces acting on the segment as a consequence of the configuration as a radial segment.

Figure 2:
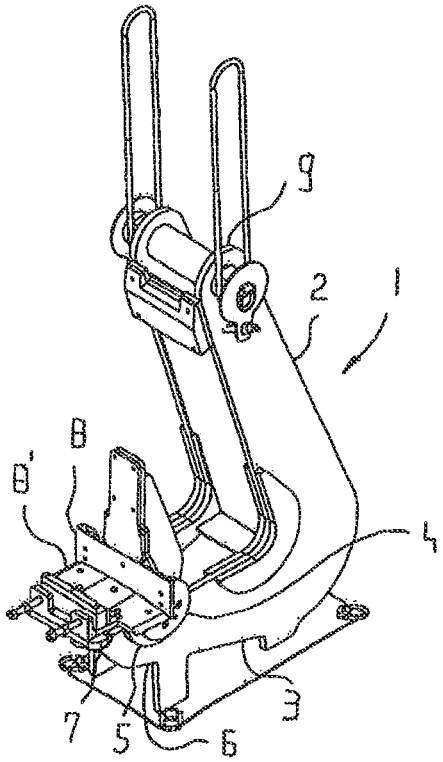
Figure 3:
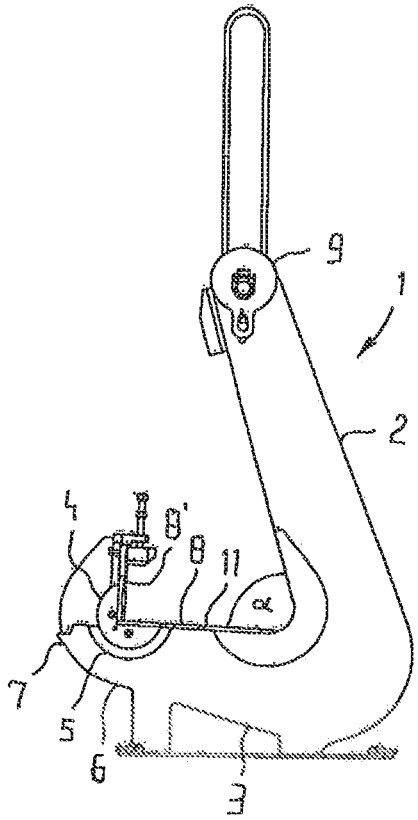

The invention is explained in greater detail below on the basis of an exemplary embodiment, with reference to the figures. Further advantages, features and configurations of the invention are set out, wherein:

FIG. 1 shows a representation of a carrying means for transporting objects in a first lateral view, FIG. 2 shows a perspective representation of a carrying means for transporting objects, FIG. 3 shows a representation of a carrying means for transporting objects in a further lateral view, wherein a planar surface is formed as a load support from the segment up to the hook mouth. According to FIGS. 1 to 3, the carrying means (1), which serves to transport objects, in particular parts of wind power plants, has a carrying limb (2) and a load handling limb (3), wherein a rotatably mounted load support is arranged in the region of a free end (7) of the load handling limb (3). The load support is configured as a segment (4) which lies on the free end (7) of the load handling limb (3) and, together therewith, forms a load-carrying bearing. At least one inner surface of the load handling limb (3), which can also mean only a part of the at least one inner surface, forms a bearing shell (5) on the free end (7) and thus corresponds to the segment (4).

In the exemplary embodiment, the load support limb extends via an imaginary vertical (10), starting from the further free end (9) of the carrying limb (2) and forms an extension region (6), wherein the load support is arranged as a radial segment (4) on the extension region (6). The segment (4) can be pivoted on multiple sides, starting from a horizontal position of at least one load support face (8, 8') of the segment (4) and has two planar load support surfaces (8, 8') arranged at a right angle to one another. The load support limb (3) has a planar inner surface (11).

If the segment (4) is now pivoted in the direction of the hook mouth, so that the first planar load support surface (8) is pivoted horizontally in the direction of the planar inner surface (11) as in FIG. 3, a planar inner surface (11) is formed, which reaches substantially from the free end (7) of the load handling limb (3) up to the hook mouth and, consequently, up to the apex of the aforementioned limbs. This affords the previously described advantages of a greater variability of the use of the carrying means in relation to the already known carrying means of an identical or similar type. In this case, the support surface (8) handles the load and can deposit said load on the planar inner surface (11) following a swiveling out into the horizontal position, or the planar inner surface (11) supports the support surface (8) during the load handling.

By contrast, in FIGS. 1 and 2, the further planar load support surface (8') is pivoted horizontally, wherein the further load support surface (8') handles the load there. In both arrangements of the load support surfaces (8) and (8'), an optimized self-alignment of the segment under stress in the direction of the action of force of an object to be transported during transport of the respective object is nevertheless afforded by means of the segment and the mounting thereof.

Moreover, the load support itself can be replaced as a segment (4). In the exemplary embodiment, the carrying limb (2) and the load handling limb (3) form an acute angle (a), the so-called hook mouth. A fastening means is arranged on a further free end (9) of the carrying limb (2).

LIST OF REFERENCE NUMERALS

1. Hook
2. Carrying limb
3. Load handling limb
4. Segment
5. Bearing shell
6. Extension region
7. Free end
8. Load support surfaces
9. Further free end
10. Vertical
11. Inner surface

The invention claimed is:

1. A carrying means (1) for transporting objects, having
a carrying limb (2) having a free end (9) and
a load handling limb (3) having a free end (7) and an end connected to the carrying limb (2), wherein
at least one load support including a segment (4) mounted pivotable about a pivot axis and having a first load support surface (8) for handling loads extending radially from the pivot axis arranged in the region of the free end (7) of the load handling limb (3),
at least one inner surface of the load handling limb (3) forms a bearing shell (5) on the free end (7) for pivotably mounting the segment (4) of the load support,
the load handling limb (3) has a planar inner surface (11),
the first load support surface (8) is pivotable between a horizontal position and a vertical position, and
the first load support surface (8) is adapted to handling a load during pivoting of the first load support surface (8) out of the vertical position into the horizontal position so that the load can be deposited on the planar inner surface (11) of the load handling limb (3) or the planar inner surface (11) supports the first load support surface (8).

2. The carrying means (1) for transporting objects according to claim 1, wherein the free end (9) of the carrying limb (2) is adapted to having a fastening means arranged thereon.

3. A carrying means (1) for transporting objects, having
a carrying limb (2) having a free end (9) and
a load handling limb (3) having a free end (7) and an end connected to the carrying limb (2), wherein
at least one load support including a segment (4) mounted pivotable about a pivot axis and having at least first and second load support surfaces (8, 8') arranged at a right angle to one another for handling loads extending radially from the pivot axis arranged in the region of the free end (7) of the load handling limb (3),
at least one inner surface of the load handling limb (3) forms a bearing shell (5) on the free end (7) for pivotably mounting the segment (4) of the load support,
the load handling limb (3) has a planar inner surface (11),
the first load support surface (8) is pivotable between a horizontal position and a vertical position, and the first load support surface (8) is adapted to handling a load during pivoting of the first load support surface (8) out of the vertical position into the horizontal position so that the load can be deposited on the planar inner surface (11) of the load handling limb (3) or the planar inner surface (11) supports the first load support surface (8).

4. The carrying means (1) for transporting objects according to claim 3, wherein the segment (4) can be pivoted at least from a horizontal position of the first load support surface (8) to a horizontal position of the second load support surface (8') and vice versa.

* * * * *